US005160306A

United States Patent [19]

Lui

[11] Patent Number: 5,160,306

[45] Date of Patent: Nov. 3, 1992

[54] SIT-UP BELT

[76] Inventor: Herman Lui, 329, W. 29th St., Apt. 405, New York, N.Y. 10001

[21] Appl. No.: 802,017

[22] Filed: Dec. 3, 1991

[51] Int. Cl.[5] ..... A63B 26/00

[52] U.S. Cl. ..... 482/140; 482/904

[58] Field of Search ..... 272/93, 900; 482/140, 482/904, 145, 148, 131; 5/1, 2.1, 288

[56] References Cited

U.S. PATENT DOCUMENTS 2,843,858 7/1958 Bjorklund ..... 482/904
3,523,310 8/1970 Shead ..... 482/904
4,378,939 4/1983 Wild .
4,515,361 5/1985 Melillo et al. ..... 482/140
4,609,188 9/1986 Lind ..... 482/140
4,611,804 9/1986 Addair ..... 482/131

*Primary Examiner*—Stephen R. Crow
*Attorney, Agent, or Firm*—Collard & Roe

[57] ABSTRACT

A sit-up exercise belt adapted to be placed under and around a corner of a mattress in such a way that a person can perform sit-up exercise by hooking and restraining the feet under the belt during exercise. The sit-up belt comprises a length adjustable belt being connected at both ends to a trapezoid belt support member which is adapted to be placed under the corner of the bed. A bar member is removably and slidably connected to the belt to further support the feet during sit-up exercise.

14 Claims, 4 Drawing Sheets

SIT-UP BELT

BACKGROUND OF THE INVENTION

The present invention relates to exercise apparatus in particular to a sit-up belt for sit-up exercise on a bed.

Apparatus for sit-up exercise for use with bed are known in prior art.

One of these sit-up exercise apparatus is disclosed in U.S. Pat. No. 4,515,361 granted to Anthony Melillo et al. This apparatus includes two rectangular members pivotally connected together at repective ends thereof. One of these rectangular members is adapted to be inserted under a mattress in such a manner that the apparatus is retained under the mattress by frictional forces as well as by weight of the mattress. The other rectangular member is in the form of a rectangular frame with an adjustable bar which may be gripped by the hand or restrain the feet of a user in the performance of various exercise. This apparatus is too bulky and contains hard edges that may be harmful to a user during exercise.

Another sit-up exercise apparatus is disclosed in U.S. Pat. No. 4,378,939 granted to Norman W. Wild. This apparatus comprises an exerciser plate being adapted to attach to bed frame by means of pressure clamps and wing nuts, a pivot arm pivotally movable in relation to the exerciser plate, and an oval loop being connected to the pivot arm. There are many disadvantages of this apparatus. It is designed to permanently installed on a particular kind of metal bed frame. Therefore, it is not portable and the use is rather limited. It contains mainly of metal parts and has sharp metal edges which are harmful to a user during exercise.

SUMMARY OF THE INVENTION

An object of the present invention is to provide a simple and easy to use sit-up exercise device adapted to be used on a bed.

Another object of the present invention is to produce a sit-up device which contains minimal metal parts and is, therefore, safe to use.

Yet another object of the present invention is to provide a portable sit-up device which is light in weight, small in size and is adapted to be carried on trip.

According to the present invention, there is provided a sit-up exercise belt adapted to be placed under and around a corner of a mattress in such a way that a person can perform sit-up exercise by hooking and restraining the feet under the belt during exercise. The sit-up belt comprises a length adjustable belt being connected at both ends to a trapezoid belt support member which is adapted to be placed under the corner of a bed. A bar member is removably connected to the belt to further support the feet during sit-up exercise.

BRIEF DESCRIPTION OF DRAWINGS

Specific embodiments of the invention will now be described by way of example with reference to the accompanying drawings wherein.

DESCRIPTION OF THE PREFERRED EMBODIMENT

Figure 1:
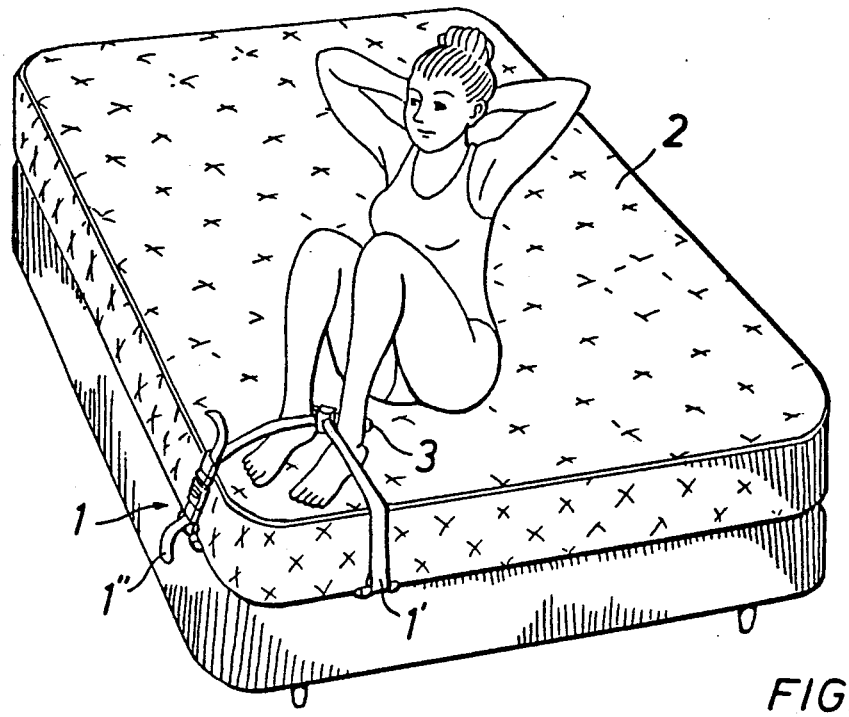
FIG. 1 shows a user doing sit-up exercise in bed using the sit-up belt according to the present invention. The sit-up belt is being mounted to a corner of a mattress.

Referring now in detail to drawings, in which like reference numerals represent like parts throughout the several views, FIG. 1 shows a user doing sit-up exercise on a bed using a sit-up exercise belt designated generally by reference numeral 1. The sit-up belt is designed to mount to a corner of a mattress 2. The user's feet are supported by the belt 1 and a bar 3 connected to the belt 1 during exercise. Detailed construction of the foot support bar 3 will be described later.

Figure 2:
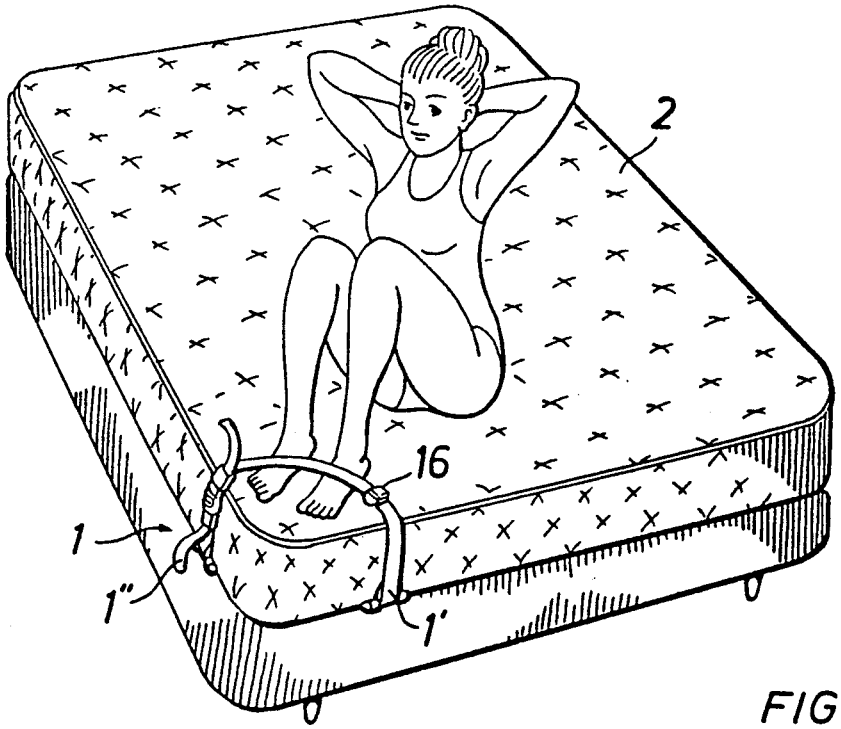
FIG. 2 shows a user doing sit-up exercise in bed using another embodiment of the sit-up belt being mounted to a corner of a mattress.

FIG. 2 shows a user doing sit-up exercise on a bed using a sit-up exercise belt 1 shown in FIG. 1. The difference is that the user's feet are supported only by the belt 1.

Figure 3:
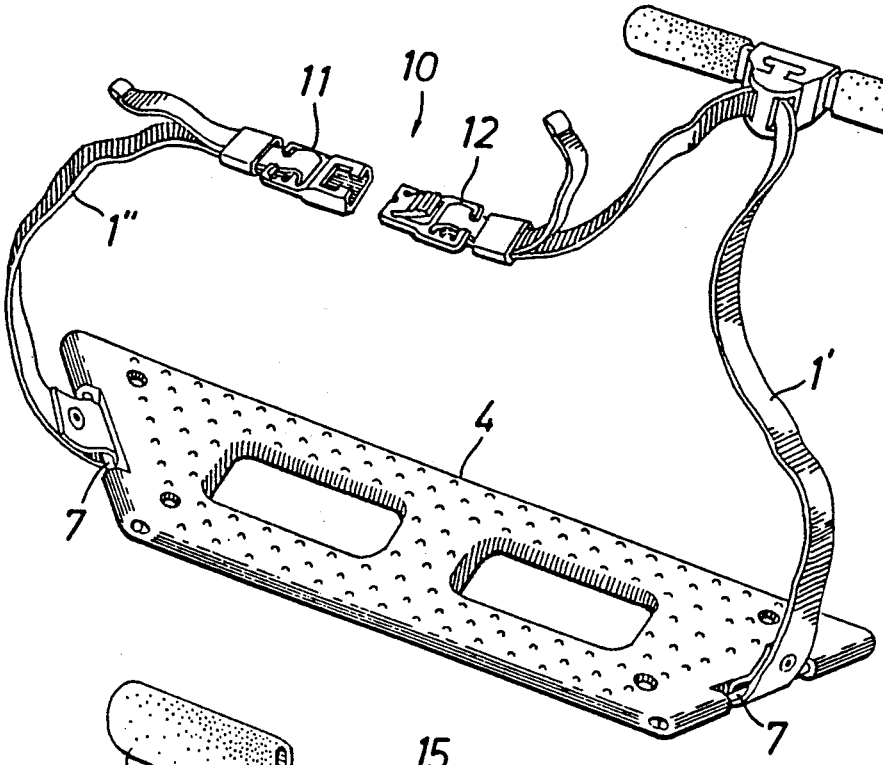
FIG. 3 is a perspective view of the sit-up belt.
Figure 4:
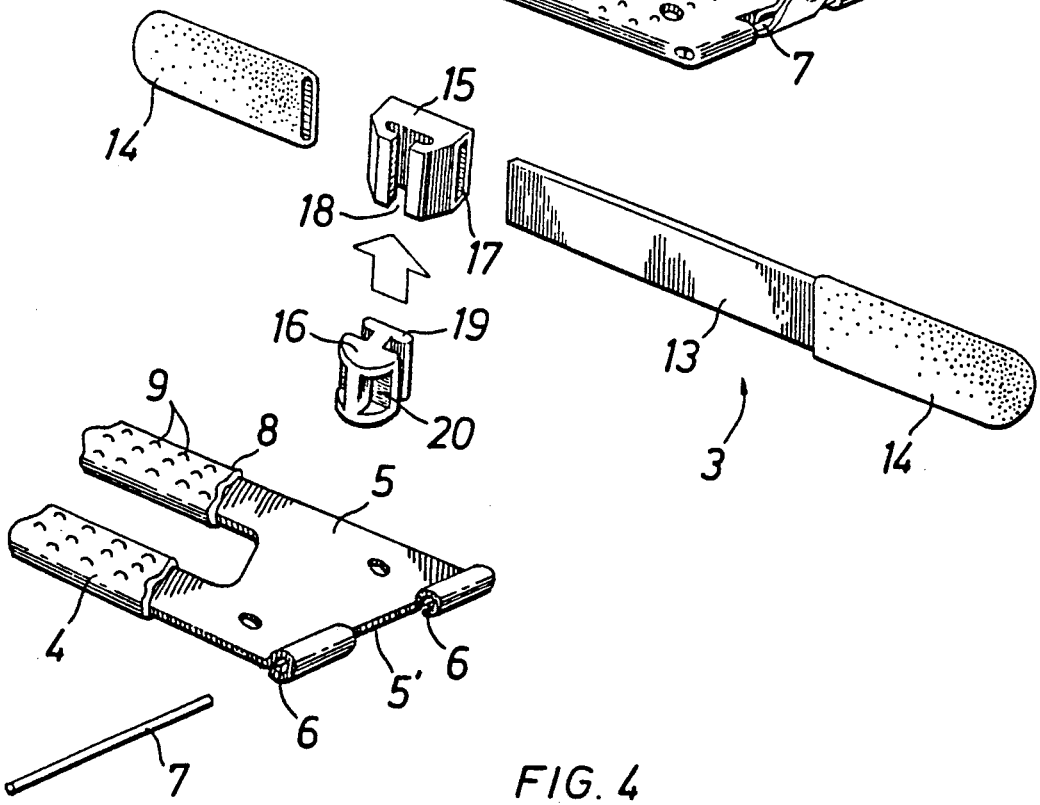
FIG. 4 is an exploded view of the parts of the sit-up belt.
Figure 5:
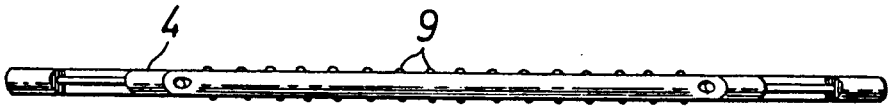
FIG. 5 is a front end view of the sit-up belt support member.

FIG. 3 is a perspective view of the sit-up belt 1 according to the present invention. The sit-up belt 1 consists of a belt retaining or support member 4 preferably in trapezoid shape. As further illustrated in FIGS. 4–6 the belt support member 4 is made of a piece of trapezoid metal plate 5. Each of the slant sides 5' of the plate 5 is integrally provided with transverse bores 6 into which the ends of a connecting pin 7 is inserted.

The metal plate 5 is preferably covered by a layer of rubber material 8, the upper and lower surfaces of which are provided with arrays of raised dots 9 for frictional purposes. This layer of rubber 8 serves as a protection against damages to the mattress and the bed. It also serves as a safety means to cover up the metal plate 5 which may be harmful to the user during exercise.

The sit-up belt 1 comprises of a first belt portion 1' and a second belt portion 1". The first belt portion 1' is pivotally connected to a slant side of the support member 4 at one end thereof by means of connecting pin 7. The second belt portion 1" is pivotally connected to the other slant side of the support member 4 by another connecting pin 7. The free ends of the first and the second belt portions 1', 1" are removably connected to each other by a conventional releasable buckle means designated generally by reference numeral 10. The first and second belt portions 1', 1" may be made of inelastic but flexible materials such as nylon or other suitable materials.

It is appreciated that all parts of the belt 1 is generally flat in shape so that the belt 1 can be packed and stored quite easily. The entire belt 1 can even be placed and stored under the mattress when it is not in use and can therefore be easily taken out and ready for performing sit-up exercise on the bed.

Figure 7:
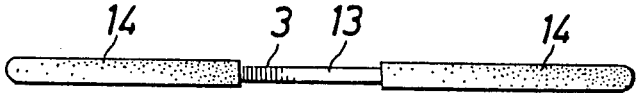
FIGS. 7 and 8 are respectively top end view and front end view of the foot support bar.
Figure 9:
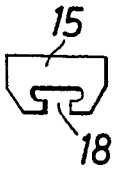
FIGS. 9–11 are respectively the top end view, front end view and side view of the foot support bar connector.
Figure 8:
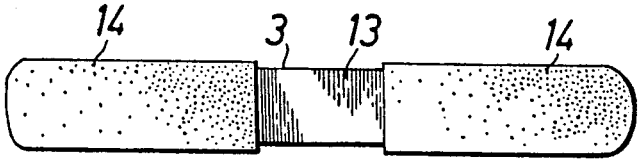
Figure 10:
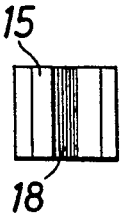
Figure 12:
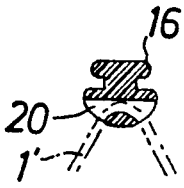
FIGS. 12–15 are respectively the sectional view, top end, view, fron end view and side view of the belt connector.
Figure 13:
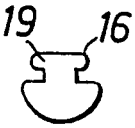
Figure 14:
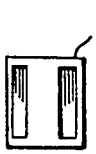
Figure 15:
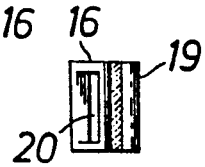
Figure 11:
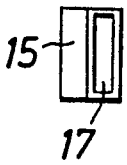

As shown in FIGS. 7 and 8, the sit-up belt further comprises a foot support bar 3. This foot support bar 3 is preferably in the form of an elongated metal plate 13, both ends of which are covered up by resilient covers 14, 14 for cushioning effect.

The foot support bar 3 is detachably connected to the sit-up belt 1 by means of a foot support bar connector 15 and a belt connector 16, as best illustrated in FIGS. 9–15. An opening slot 17 is provided on the foot support bar connector 15 through which the plate 13 is inserted. The foot bar connector 15 is disposed at the center of the support bar 3. The connector 15 is slidably connected to the belt connector 16 by means of a T-shaped female element 18 and a T-shaped male element 19 integrally provided on foot bar connector 15 and belt connector 16 respectively, as shown by the arrow in FIG. 4.

The belt connector 16 is provided with a slot 20 through which the belt portion 1' is inserted thereby allowing the belt connector 16 to be slidably connected to the belt portion 1'.

When doing sit-up exercise, a user places the sit-up belt support member 4 under a corner of a mattress, as shown in FIGS. 1 and 2 in such a manner that the belt portions 1' and 1'' are extending upwardly from the sides of the mattress and around the top surface of the corner of the mattress. The belt portion 1' is longer than the belt portion 1'' so that the buckle 10 is abutted generally against a side of the mattress and away from the portion of the sit-up belt 1 likely to be in contact with the feet of the user. This would eliminate the chance of injury of feet of the user during exercise.

The position of the buckle 10 relative to the mattress can be adjusted by a conventional length adjustment means 11 disposed generally at the free end of the belt portion 1''. And, the tightness of the sit-up belt 1 around the corner of the mattress can be adjusted by a conventional length adjustment means 12 disposed generally at the free end of the belt portion 1'.

A user may do sit-up exercise by the support of the belt portion 1' and the foot support bar 3. In this way, the feet are to be hooked under the belt portion 1' with the Achilles' tendon of the feet being abutted against the respective sides of the support bar 3, as illustrated in FIG. 1.

Alternatively, a user may do sit-up exercise by the support of the belt portion 1' alone. In this way, the foot support bar 3 with the bar connector 15 is detached from the belt connector 16, and the belt connector 16 is slid aside along the belt portion 1' so that it is away from the belt portion likely to be in contact with the feet of the user during exercise. This would make sit-up exercise more safe and comfortable.

Figure 6:
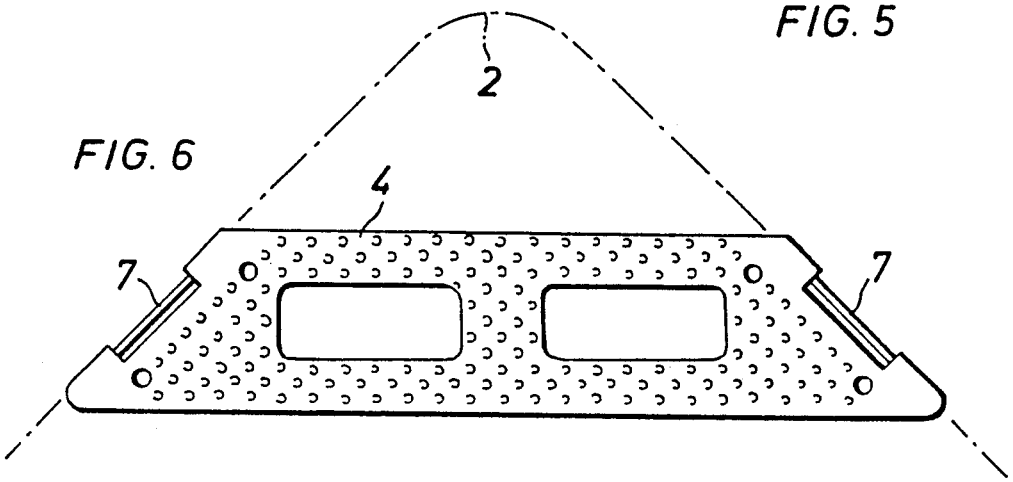
FIG. 6 is a plan view of the sit-up belt support member of FIG. 5 with a dot and dash line showing the edge of a corner of a mattress. The underneath plan view of the support member corresponds to the plan view thereof.

In accordance with the above-mentioned sit-up exercise, the sit-up belt support member 4 is simply placed between the mattress and the bedstead without any additional fixation. The belt support member 4 is held in position by the looping of the sit-up belt around the corner of the mattress as well as by the weight of the mattress. The addition of friction between the specially designed support member 4 and the mattress also helps in retaining the support member 4 in a desired position under the corner of the mattress, as depicted in FIG. 6.

Figure 16:
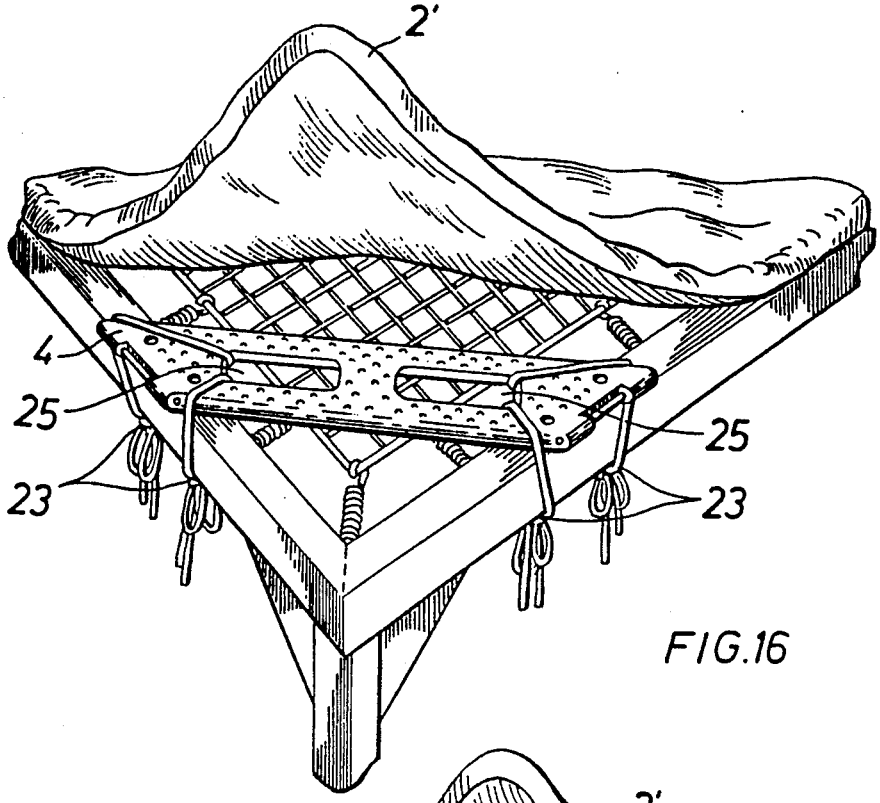
FIG. 16 shows a sit-up belt support member being tied up to the frame of a bed.
Figure 17:
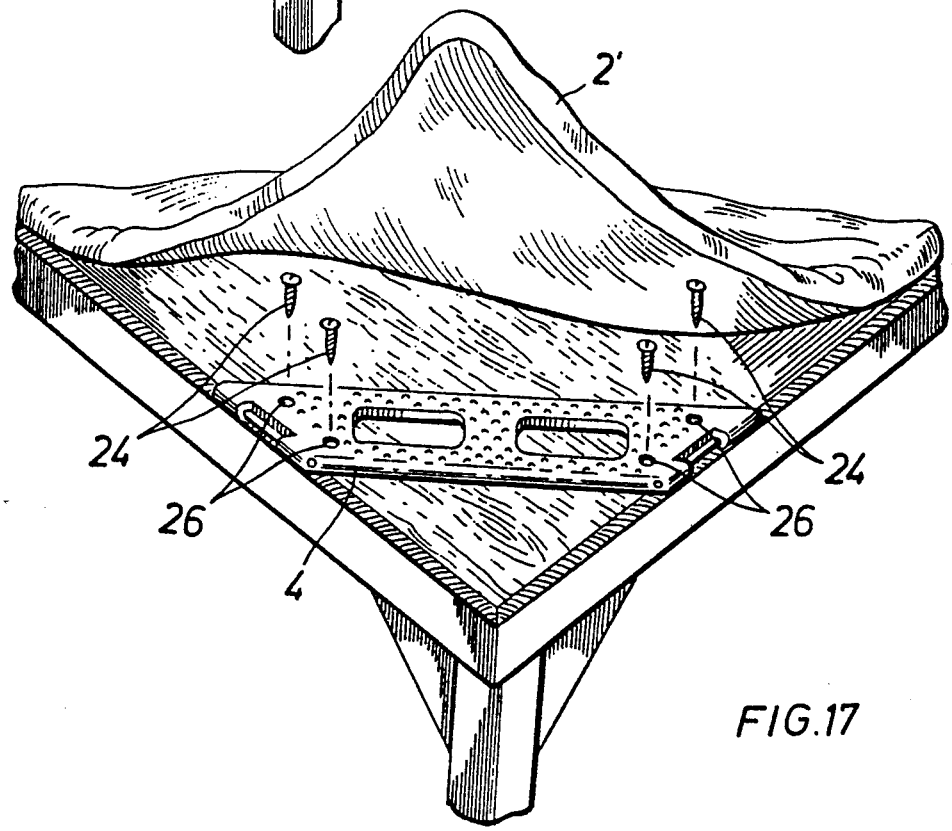
FIG. 17 shows a sit-up belt support member being screwed on the frame of a bed by screw means.

However, this is the case only if the mattress is thick and stiff enough to uphold the force exerted by the user during sit-up exercise. For use with mattress that is quite thin and flexible, additional fixation means has to be employed. FIGS. 16 and 17 show ways of fixing the sit-up belt support member 4 at the corner of a bed having a thin mattress 2'.

FIG. 16 shows a bed with a metal open frame and a piece of mattress supporting net element being held within the open frame by means of a plurality of metal springs. The belt support member 4 may be, in this case, tied up at the corner of the bed frame by rope means 23 through openings 25 provided on the support member 4. This may allow ready removal of the sit-up belt from the bed when it is not in use by simply untying the ropes.

FIG. 17 shows a bed with a metal or wooden frame with a piece of wooden mattress supporting board being fixed on top of the frame. The belt support member 4 may be, in this case, screwed on the corner of the wooden board by screw means 24 through screw holes 26 provided substantially adjacent the slant sides of the trapezoid support member 4. This may also allow the trapezoid support member 4 to be fixed on a bench or even on the floor.

Although the sit-up exercise belt of the present invention has been described hereinbefore as an exercise device for sit-up, it is contemplated that the sit-up belt may be used in performing other kinds of exercise on the bed. Since the sit-up exercise belt is positioned at a corner of the bed, sit-up or other exercise can be done diagonally on the bed, thereby providing more space for a user to stretch the body in the course of exercise. The user may select any of the four corners of the mattress depending on the environment around the bed.

While present invention has been shown with particular reference to a preferred embodiment thereof, it should be noted that various other charges of modifications may be made without departing from the scope of the present invention.

What is claimed is:

1. A sit-up exercise device to be used in conjuction with a bed having mattress, said device comprising:

(a) belt means to be disposed around a corner of the mattress;

(b) means for adjusting the length of the belt means; and (c) means being connected to said belt means and adapted to be disposed under the corner of the mattress for retaining the belt means around the corner of the mattress during exercise said retaining means is in the form of a planar trapezoid member shaped to generally contour with the corner edges of the mattress and adapted to be placed under a corner of the mattress and held in position by the belt means and the weight of the mattress.

2. A device as claimed in claim 1, wherein the upper and lower surfaces of said planar trapezoid member are provided with arrays of raised dots to further hold the retaining means in position by frictional force.

3. A device as claimed in claim 1, wherein said device further comprises a bar means and a connecting means for removably and slidably connecting said bar means to the belt means.

4. A device as claimed in claim 1, wherein said retaining means further comprises means for attaching said retaining means to a corner of the frame of a bed under the mattress.

5. A device as claimed in claim 4, wherein said attaching means is in the form of screw means for screwing the retaining means on a corner of the frame of a bed through corresponding screw holes provided on the retaining means.

6. A device as claimed in claim 4, wherein said attaching means is in the form of rope means for tying up the retaining means on a corner of the frame of a bed through openings provided on the retaining means.

7. A sit-up exercise device to be used in conjunction with a bed having mattress, said device comprising:

(a) belt means to be disposed around a corner of the mattress;

(b) means for adjusting the length of the belt means;

(c) means being connected to said belt means and adapted to be disposed under the corner of the mattress for retaining the belt means around the corner of the mattress during exercise; and wherein said belt means comprises a first belt portion and a second belt portion, one end of said first belt portion is pivotally connected to one end of the retaining means and one end of said second belt portion is pivotally connected to another end of the retaining means the free ends of said first and second belt portions are connected together by buckle means, said first belt portion is longer than said second belt portion such that said buckle means is generally abutted against a side of the mattress.

8. A device as claimed in claim 7, wherein said retaining means is in the form of a planar trapezoid member adapted to be placed under a corner of the mattress and held in position by the belt means and the weight of the mattress.

9. A device as claimed in claim 8, wherein the upper and lower surfaces of said planar trapezoid member are provided with arrays of raised dots to further hold the retaining means in position by frictional force.

10. A device as claimed in claim 7, wherein said device further comprises bar means removably and slidably connected to the belt means by connecting means.

11. A sit-up exercise device to be used in conjunction with a bed having mattress, said device comprising:

(a) belt means to be disposed around a corner of the mattress;

(b) means for adjusting the length of the belt means;

(c) means being connected to said belt means and adapted to be disposed under the corner of the mattress for retaining the belt means around the corner of the mattress during exercise; and said device further comprises bar means removably and slidably connected to the belt means by connecting means; and, wherein said connecting means comprises a bar connector being connected to the bar means at the central portion thereof and having a female element, and a belt connector being slidably connected to the first belt portion and having a male element, said male element is removably coupled to said female element, whereby said bar means can provide foot support for a user of the sit-up exercise device.

12. A device as claimed in claim 11, wherein said retaining means further comprises means for attaching said retaining means to a corner of the frame of a bed under the mattress.

13. A device as claimed in claim 12, wherein said attaching means is in the form of screw means for screwing the retaining means on a corner of the frame of a bed through corresponding screw holes provided on the retaining means.

14. A device as claimed in claim 12, wherein said attaching means is in the form of rope means for tying up the retaining means on a corner of the frame of a bed through openings provided on the retaining means.

* * * * *